US010738681B2

(12) United States Patent
Boffelli

(10) Patent No.: US 10,738,681 B2
(45) Date of Patent: Aug. 11, 2020

(54) APPARATUS FOR ACTUATING AND CONTROLLING THE ROTATION OF BLADES OF FANS FOR COOLING THE COOLANT IN MACHINES/VEHICLES

(71) Applicants: BARUFFALDI S.p.A., Tribiano (MI) (IT); Piercarlo Boffelli, Tribiano (IT)

(72) Inventor: Piercarlo Boffelli, Tribiano (IT)

(73) Assignee: BARUFFALDI S.P.A., Tribiano (MI) (IT)

( * ) Notice: Subject to any disclaimer, the term of this patent is extended or adjusted under 35 U.S.C. 154(b) by 123 days.

(21) Appl. No.: 15/773,861

(22) PCT Filed: Nov. 11, 2015

(86) PCT No.: PCT/EP2015/076298
§ 371 (c)(1),
(2) Date: May 4, 2018

(87) PCT Pub. No.: WO2017/080593
PCT Pub. Date: May 18, 2017

(65) Prior Publication Data
US 2019/0162105 A1 May 30, 2019

(51) Int. Cl.
*F04D 29/32* (2006.01)
*F01P 7/06* (2006.01)
(Continued)

(52) U.S. Cl.
CPC ..... *F01P 7/06* (2013.01); *F01P 7/084* (2013.01); *F04D 19/002* (2013.01);
(Continued)

(58) Field of Classification Search
None
See application file for complete search history.

(56) References Cited

U.S. PATENT DOCUMENTS 5,146,145 A * 9/1992 Wood ..... H02K 21/16 318/400.04
5,679,089 A * 10/1997 Levedahl ..... F16H 48/10 475/332
(Continued)

FOREIGN PATENT DOCUMENTS

EP 1319814 A2 * 6/2003 ..... F01P 7/06

*Primary Examiner* — Michael Lebentritt

(57) ABSTRACT

Apparatus for actuating and controlling the rotation, about their longitudinal axis (Y-Y), of blades (20) of cooling fans (10) for operating machines and/or vehicles, in particular agricultural tractors and off-road vehicles, said fan being mounted on a hub (11) which can be rotationally driven about its axis (X-X) by associated driving means (3,3*a*) suitable for connection to the heat engine (1) and mounted on a fixed support (5) by means of a bearing (3*b*) the apparatus comprising a ring (71) provided with a radial seat (71*a*) inside which a radial pin (72), eccentrically engaged in a base (73) integral with the shank (20*a*) of the blade (20), is inserted; an electric motor (30) which is coaxial with the axis (X-X) of the hub (11) and the shaft (31) of which is coaxially connected to a reduction gear (40), the kinematic output element (143) of which is coaxially connected by means of a screw (51*a*)/female thread (76*a*) coupling to a slider (76) displaceable in both directions along the axis (X-X) and kinematically connected to the ring (71) with an eccentric pin (72) driving the base (73) of the shank of the blade, an electromagnetic clutch (80; 180; 280) being arranged between the pulley (3) and the hub (11) of the fan.

22 Claims, 5 Drawing Sheets

(51) Int. Cl.
*F01P 7/08* (2006.01)
*F04D 29/36* (2006.01)
*F04D 19/00* (2006.01)

(52) U.S. Cl.
CPC ..... *F04D 29/362* (2013.01); *F04D 29/323* (2013.01); *F05D 2260/74* (2013.01); *F05D 2260/76* (2013.01)

(56) References Cited

U.S. PATENT DOCUMENTS

| | | | | | |
|---|---|---|---|---|---|
| 6,000,910 | A * | 12/1999 | Ahn | F04D 25/105 | 416/98 |
| 7,144,225 | B2 * | 12/2006 | Boffelli | F01P 5/12 | 417/223 |
| 2002/0117916 | A1 * | 8/2002 | Terada | B62M 7/12 | 310/75 C |
| 2006/0027192 | A1 * | 2/2006 | Tsukada | B60K 1/00 | 123/41.7 |
| 2006/0086585 | A1 * | 4/2006 | Boffelli | F01P 5/04 | 192/84.31 |
| 2006/0137956 | A1 * | 6/2006 | Boffeli | F01P 7/046 | 192/48.2 |
| 2007/0188039 | A1 * | 8/2007 | Migita | H02K 1/148 | 310/216.004 |
| 2011/0253077 | A1 * | 10/2011 | Boffelli | F01P 5/04 | 123/41.44 |

* cited by examiner

APPARATUS FOR ACTUATING AND CONTROLLING THE ROTATION OF BLADES OF FANS FOR COOLING THE COOLANT IN MACHINES/VEHICLES

BACKGROUND OF THE INVENTION

Field of the Invention

The present invention relates to an apparatus for actuating and controlling the rotation, about their axis, of the blades of fans for cooling the coolant contained in the radiator of operating machines and/or vehicles, in particular agricultural tractors and off-road vehicles.

It is known that the operation of operating machines and vehicles by means of a heat engine involves the need to cool the latter by means of a coolant which is stored inside a cellular radiator and recirculated through the engine; the coolant is in turn cooled by the ambient air which is forced to pass through the radiator by the sucking action of a rotating fan.

Taking as a reference point the normal front part of the machine/vehicle the three elements are axially arranged with the radiator at the front, engine behind and fan arranged between the two.

It is also known that, in the technical sector of vehicles which are generally used in conditions where there is a large quantity of loose debris, as in the case of agricultural tractors or vehicles intended for off-road use, but also operating machines which work under stationary conditions, this loose debris tends to be deposited on the cellular surfaces of the radiator containing the vehicle coolant, causing blockage thereof and therefore a reduced and/or no cooling of the fluid, with consequent overheating of the engine.

It is also known that the main cause of said accumulation of debris on the radiator is the forced air flow of the fan which is arranged behind the radiator in the direction of travel of the vehicle and connected to the driving shaft thereof, said fan, when made to rotate, drawing in the air and forcing it to pass through the radiator, causing dissipation of the heat from the coolant contained inside it, at a higher temperature, into the external environment, at a lower temperature.

It is also known that, under normal operating conditions, said fan must be made to rotate only when a certain predefined temperature of the coolant is reached, this being detected by means of a thermostat. In greater detail it is required that a motor vehicle fan should be able to draw air from the radiator towards the heat engine:

- in a small amount for cooling in conditions where there is a low external temperature,
- in a large amount when there are higher external temperatures or when the vehicle is used in demanding conditions resulting in overheating of the engine, but also
- air must be temporarily forced onto the radiator in the opposite direction in order to clean it of the impurities which have accumulated during normal operation.

In order to determine these operating conditions, fan driving apparatus able to produce controlled rotation of the fan blades from an air suction condition into a condition for propelling air onto the radiator, and vice versa, are known, whereby in the suction condition the angle formed by the surface of the blades with the axial direction of air flow—below referred to as entry angle—may be adjusted within a certain range in order to increase/decrease the flow according to the actual fluid cooling requirements.

Although these apparatus, which are mainly of the fluid-dynamic actuating type, fulfil their function, they nevertheless require special means for supplying the fluid to the blade movement devices, said means: either are not always being present on the vehicles or require the installation of a compressor or connection pipes, this requirement, besides from increasing the costs, is not always physically feasible.

In addition, the position of the blades at the various entry angles of the blades is unstable and requires complicated auxiliary locking elements such as counterweights or the like for opposing the air thrust which tends to cause rotation of the blades in the opposite direction to the set direction, resulting in undesirable and noisy angular vibrations of the blades.

DESCRIPTION OF THE RELATED ART

WO02/055845-A describes an apparatus for controlling the rotation, about its axis, of a fan of an airplane turbine. The apparatus comprises an electric motor connected to a reduction gear, the output of which is connected to an endless screw on which a female-thread nut moves axially by means of rotation. The nut is fixed to the eccentric pin of the shank of the blade which, when the nut moves axially, varies its angle of orientation about its axis.

The apparatus of WO'845 is not suitable for installation in the confined space between heat engine and radiator inside the engine compartment of operating machines or land vehicles. In addition, it is unable to provide a fully stopped operating mode, which cannot be considered for aeronautical applications where the propeller is constantly rotating and which, instead, is particularly desirable for land vehicles also intended for use in cold climates with sub-zero temperatures, where rotation of the cooling fan is not desirable in particular during a cold start-up.

EP0967104A2 discloses a fan for vehicles with an apparatus for actuating and controlling the rotation about their longitudinal axis of the fan blades, wherein said fan is mounted on a hub which can be rotationally driven about its axis by driving means connected to a heat engine of the vehicle and mounted on a fixed support by means of a bearing; the apparatus comprises a disk provided with a radial seat inside which a radial pin is inserted, which radial pin is arranged eccentrically with respect to the shank of the blade and is inserted in a first end of an L-shaped rotating lever the other end of which is in turn pivotally joined with the shank of the blade; and a double acting hydraulic actuator which is coaxial with the axis of the hub and the shaft of which is a kinematic output element coaxially connected by means of a screw/female thread coupling to a slider axially displaceable along the hub axis and connected to the disk with radial pin for driving rotation of the lever and thus of the blade shank.

DE 1 294 588 discloses a fan with a lantern into which blades are rotatably mounted. The fan is keyed on a drive shaft. Concentric with the fan, a planetary gear is fixed to an extension of the shaft, the planetary gear is driven by a motor fixed to the outside of the fan lantern, whereby planetary gear and motor rotate integrally with the fan, fan lantern and drive shaft. The output of the planetary gear is designed as a radial rotating collar to which a radially extending adjustment disc is flanged. From the adjusting disk, a rotational movement is transmitted by means of angle joints to an adjusting lever fastened to the blade shank.

Therefore, DE'588 describes a fan configuration wherein the motor and the planetary gear are rotationally integral with the fan hub and the fan, and wherein the transmission of the adjustment movement from the planetary gear to the blade shank happens by means of a radially extending, rotating disk which rotates concentrically with the planetary gear to actuate an angle joint with lever.

BRIEF SUMMARY OF THE INVENTION

The technical problem which is posed, therefore, is that of providing an apparatus for actuating and controlling rotation, about their longitudinal axis, of the blades of fans for cooling the coolant in operating machines and/or vehicles, in particular vehicles such as agricultural tractors and off-road vehicles, which is able to perform both effective cooling of the coolant during normal use of the machine/vehicle and cleaning of the radiator cells should they become blocked.

Preferably it is required that the fan should be able to be stopped in the so-called "fully stopped" condition where, after interruption of operation, it is kept in a completely immobile and not just idle condition, in order to prevent any residual power consumption due to residual rotation of the fan caused by friction in the kinematic chain for controlling rotation.

In connection with this problem it is also required that this apparatus should have small dimensions, in particular small radial dimensions, which make it suitable for being housed within the confined space between the heat engine and radiator inside the engine compartment of operating machines or land vehicles and should be able to be produced and assembled in an easy and low-cost manner in any operating machine/vehicle without the need for auxiliary devices and/or complicated connection lines.

These results are achieved according to the present invention by a fan assembly with an apparatus for actuating and controlling the rotation, about their axis, of the blades of fans for cooling the coolant contained in the radiator of vehicles, in particular agricultural tractors and off-road vehicles, and/or operating machines according to the herein disclosed subject matter.

BRIEF DESCRIPTION OF THE SEVERAL VIEWS OF THE DRAWINGS

Further details may be obtained from the following description of a non-limiting example of embodiment of the subject of the present invention, provided with reference to the accompanying drawings, in which.

DETAILED DESCRIPTION OF THE INVENTION

Figure 1:
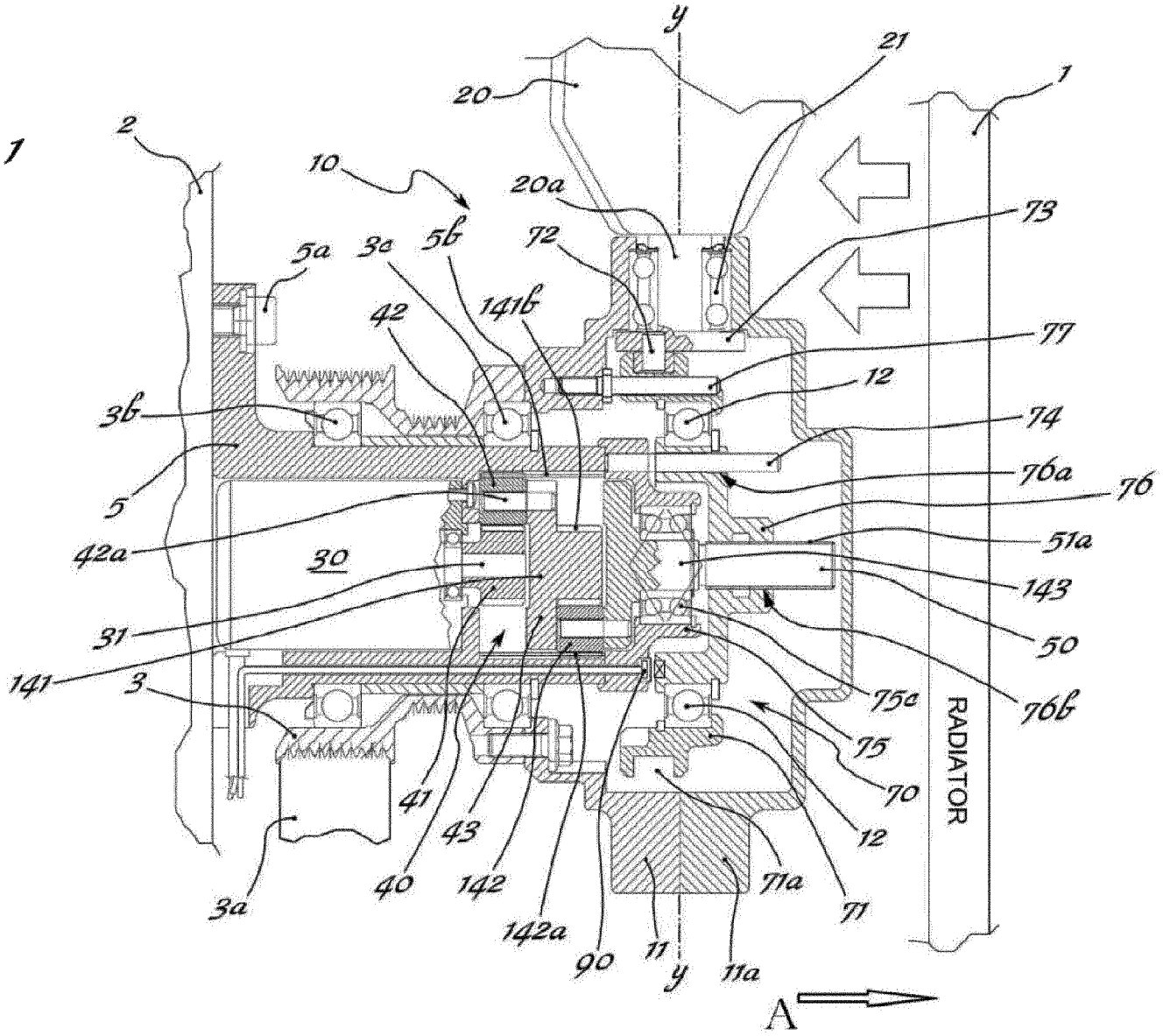
FIG. 1 shows an axial vertical section through the apparatus according to the present invention in conditions where air is being sucked through the radiator for normal cooling of the fluid.

As shown in FIG. 1 and assuming solely for the sake of easier description and without a limiting meaning a longitudinal axis X-X corresponding to the axis of rotation of a fan 10 and, with reference to the direction of travel of a vehicle indicated by the arrow "A", a front part corresponding to the position of a radiator 1 and a rear part corresponding to the position of the heat engine 2, the fan 10 is arranged behind the radiator 1 and in front of the engine 2 and comprises a hub 11 which is preferably closed at the front by a bell member 11*a*.

The hub 11 is axially locked to a pulley 3 for rotationaly driving the fan and connected by means of a suitably driven belt 3*a* to the shaft of heat engine 2.

The pulley 3 is mounted on a pair of bearings 3*b*,3*c* which are keyed onto a fixed support element, in the example described consisting of a sleeve 5 which is fixed to the base of the engine 2 via associated means 5*a* and inside which the apparatus for controlling rotation of the blades 20, described below, is preferably partially contained.

The hub 11 supports the blades 20 of the fan which are radially connected to said hub 11 by means of a respective shank 20*a* and via a bearing 21 which allows rotation thereof about an associated longitudinal axis Y-Y of each blade.

The apparatus for controlling rotation of the blades 20 about their longitudinal axis Y-Y comprises an electric motor 30 which is coaxially inserted inside the sleeve 5 and the shaft 31 of which is connected to an epicyclic reduction gear 40 situated axially in front of said electric motor. The kinematic output element 143 of the epicyclic reduction gear is connected to a screw 50, the threading 51*a* of which is connected to the female thread 76*b* of a flange 76 retained by the inner race of a bearing 12, the outer race of which supports the device 70 for adjusting the entry angle of the blades 20, described below.

According to a preferred embodiment the epicyclic reduction gear 40 is of the multi-stage type.

Preferably it comprises a first stage formed by:

- a sun gear 41 rotationally locked with the shaft 31 of the motor 30;
- planet gears 42 which are joined, by means of axial pins 42*a*, to a planet carrier 43 and mesh both with the sun gear 41 and with internal teeth 5*b* of the sleeve 5, provided along a suitable axial portion thereof, thus forming the bell member of the first stage of the epicyclic reduction gear;

and a second stage in turn comprising:

- a sun gear 141 formed by means of an axial extension with teeth 141*b* of the planet carrier 43 of the first stage;
- planet gears 142 meshing by means of respective teeth 142*a* on the said sun gear 141 and on the said teeth 5*b* of the sleeve 5 which thus forms the bell member of the second stage of the epicyclic reduction gear;
- a planet carrier 143, the front end of which forms the output of the kinematic chain and carries the said screw 50.

The multi-stage epicyclic reduction gear constitutes a preferred embodiment of a reduction gear which is able to achieve the correct reduction ratio between the shaft 31 of the electric motor 30 and the actuating screw 50 of the slider 76 of a device for adjusting the rotation of the blades 20 about their longitudinal axis Y-Y, ensuring the coaxial arrangement of the input and the output of the kinematic chain, while favouring the simplicity of the device and limiting the radial dimensions of the assembly.

The device 70 for adjusting the entry angle of the said blades 20 is arranged between the bearing 12 for rotation of the hub 11 and the shank 20*a* of the blades 20.

The device 70 preferably comprises a ring 71 fixed to the bearing 12 and provided with a radial seat 71*a* inside which a radial pin 72, eccentrically engaged in a base 73 integral with the shank 20*a* of the blade 20, is inserted. The ring 71 is preferably axially guided by a first rod 77 extending parallel to the axis X-X and locked on the hub 11 together with which it may rotate, but relative to which it remains axially fixed.

A second rod 74 extends axially from a counter-plate 75 fixed to the sleeve 5 and supported by a bearing 75*c* mounted on the kinematic output of the epicyclic reduction gear, crossing an associated seat 76*a* passing axially through the slider 76 supported by the inner race of the bearing 12 and provided with a female thread 76*b* for engagement with the thread 51*a* of the screw 50; the slider is thus displaceable and axially guided by the rod 74, but rotationally still.

The apparatus further comprises, preferably, a sensor 90 for detecting the axial distance between the slider 76 and the fixed counter-plate 75, said sensor 90 being connected to devices not shown—for programming and controlling rotation of the blades 20.

The axial position sensor 90 is designed, among other things, to allow the use of a (sensorless) engine without angular positioning device (encoder) and perform intelligent management by means of the operating system on-board the engine and to allow definition, by means of said sensor 90, of an initial start point which will be managed during switching-off or start-up of the vehicle.

Basically during start-up and switching-off of the vehicle the blades will always be brought back into the rest condition so as to reset the sensor. At this point the operating system is able to manage (by means of a data matrix) all the positions requested by the system, correctly positioning the blades in the optimum condition.

According to preferred embodiments of the motor 30 it is envisaged that the same may be of brushless type and used as a brake for keeping the driving shaft in position, preventing possible movements due to thrusts and vibration determined by the heat engine; the use in this connection may be obtained either under the control of the operating system or by short-circuiting the windings or by powering with a reduced voltage a single phase which will oppose the action of the permanent magnets of the motor, keeping it still.

Figure 2:
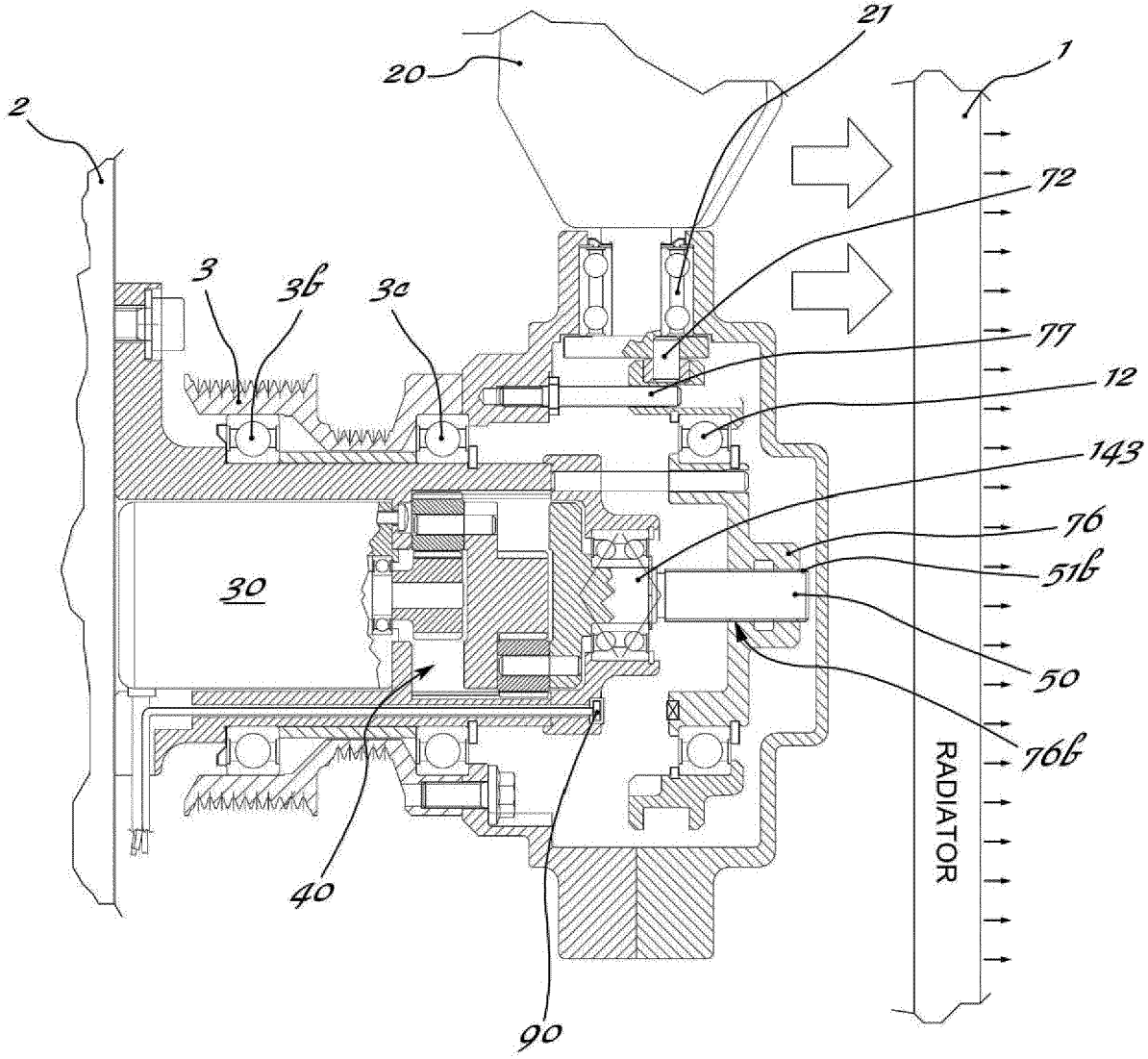
FIG. 2 shows a cross-section, similar to that of FIG. 1, of the apparatus according to the present invention in conditions where the air is being blown onto the radiator in order to clean it.

With reference to this configuration the operating principle of the apparatus is now explained:

under normal operating conditions corresponding to cooling of the coolant contained inside the radiator 1 (FIG. 1):

the fan is made to rotate by the pulley 3 connected to the hub 11 with a number of revolutions dependent on the heat engine, and the apparatus for controlling the entry angle of the blades 20 envisages recall by means of axial displacement of the slider 76 towards the heat engine 2; recall is performed by means of the electric motor 30, the epicyclic reduction gear 40 and the screw 50 engaged with the female thread 76*a* of the slider 76; the displacement of the slider causes the displacement of the ring 71 which moves the eccentric pin 72, causing rotation of the base 73 connected to the shank 20*a* of the blade 20 that therefore starts to rotate; in this condition, on the basis of the temperature data of the coolant and the relative distance between the slider 76 and the counter-plate 75 detected by the respective sensors, the actuating means operate the motor 30 so as to vary suitably the entry angle of the blades 20 in order to calibrate correctly the air flow drawn through the radiator 1 depending on the actual cooling requirements.

during operating conditions corresponding to the need to clean the accumulated debris from the cells of the radiator (FIG. 2):

the motor 30 and therefore the screw 50 are operated in the opposite direction so as to move the slider away from the sleeve 50, slider which, moving also the ring 71 and the pin 72, causes rotation of the blade 20 about its axis Y-Y until an angular position which produces the blowing of air onto and through the radiator 1 is reached, resulting in elimination of the debris which has accumulated between the cells.

In order to avoid undesirable rotations of the blades 20 about their longitudinal axis Y-Y in the opposite direction to that desired, the connection between screw 51*a* and female thread 76*a* is provided with a very small pitch, for example metric pitch, and therefore such as to determine irreversibility of the transmission so as to prevent rotation, about their longitudinal axis Y-Y, of the blades which may rotate upon operation of the engine, but not return owing to the air thrust on them alone, thus being able to oriented in a wide angular range and remain stable once they have reached the set position.

A further additional effect for irreversibility of rotation of the blades may also be obtained with a correct reduction ratio of the multi-stage epicyclic reduction gear.

In addition, with use of an electric motor which with the power supplies described above may also function as a brake, the vibrations which are due to the heat engine and which, acting on the hub of the fan, would result in undesirable oscillations about their axis of rotation are neutralized.

The invention also envisages an embodiment of the apparatus able to provide a fully stopped operating mode in order to prevent undesirable residual rotations of the fan, which are mainly due to the relative friction between blades and air, even when the entry angle of the blades is substantially equal to zero, and are particularly undesirable for low-temperature use.

For this purpose (FIG. 3) the arrangement of an electromagnetic clutch 80 between the pulley 3 and the hub 11 of the fan is envisaged.

In detail, the clutch 80 comprises a rotor 81 integral with the pulley 3 by means of which it is kept in rotation and mounted on the outer race of the bearing 103*b* for supporting the pulley 3, keyed onto the sleeve 5 fixed to the base of the engine 2, a fixed annular electromagnet 82 concentric with the pulley 3, the electromagnet 82 being electrically connected to a thermostat (not shown) for detecting, for example, the temperature of the coolant.

A driven armature 83 is arranged on the opposite side to the electromagnet 82, relative to the rotor 81, and is connected to an axial extension 11*a* of the hub 11 by means of a resilient element 83*a* designed to allow axial movements of the armature 83, but also prevent the relative rotation of armature and support.

The concentric arrangement of the pulley, the electromagnet 82 and the electric motor 30 allows the clutch to be designed with a size depending on the torque requirements, but to the detriment of maintaining a small radial dimension of the apparatus. The multi-stage epicyclic reduction gear, however, enables this radial volume to be compensated for by means of a suitable choice of the number and size of the reduction gear stages.

Figure 3:
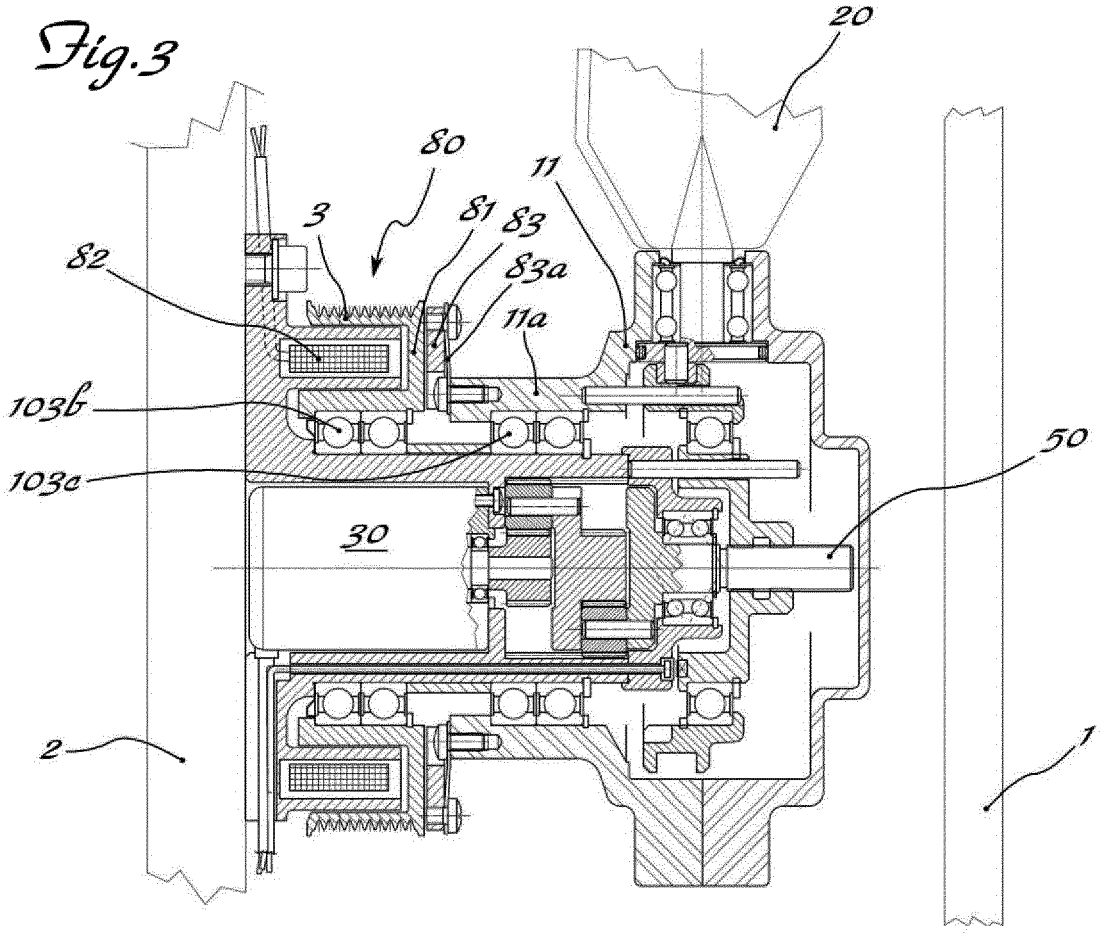
FIG. 3 shows a cross-section, similar to that of FIG. 1, of a second embodiment of the apparatus according to the present invention able to provide a fully stopped operating mode.
Figure 4:
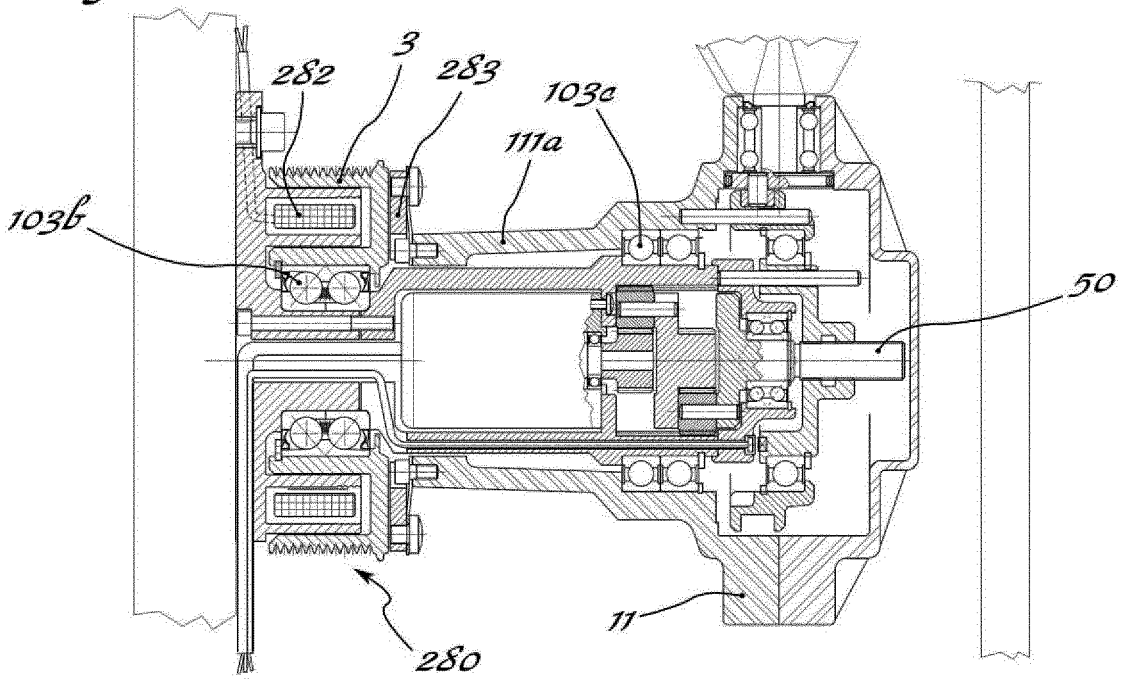
FIG. 4 shows a cross-section, similar to that of FIG. 1, of a variation of embodiment of the apparatus shown in FIG. 3 for the fully stopped operating mode.

FIG. 4 shows a further variation of embodiment of the apparatus where the electromagnet 282 of the clutch 280 is arranged concentrically with the pulley 3 and the support bearing 103*b*, in a similar manner to that described in connection with FIG. 3; in this case, however, the axial extension 111*a* of the hub is prolonged towards the heat engine 2 until the clutch 282,283 is brought into a position axially on the outside of the electric motor 30 for rotational operation of the blades 20 so as to be able to obtain, albeit with an increase in the axial dimension of the apparatus, a reduction in the radial dimension of said apparatus also in the case of a clutch concentric with the pulley. This reduction in combination with use of the multi-stage epicyclic reduction gear results in an apparatus which is extremely compact radially.

Figure 5:
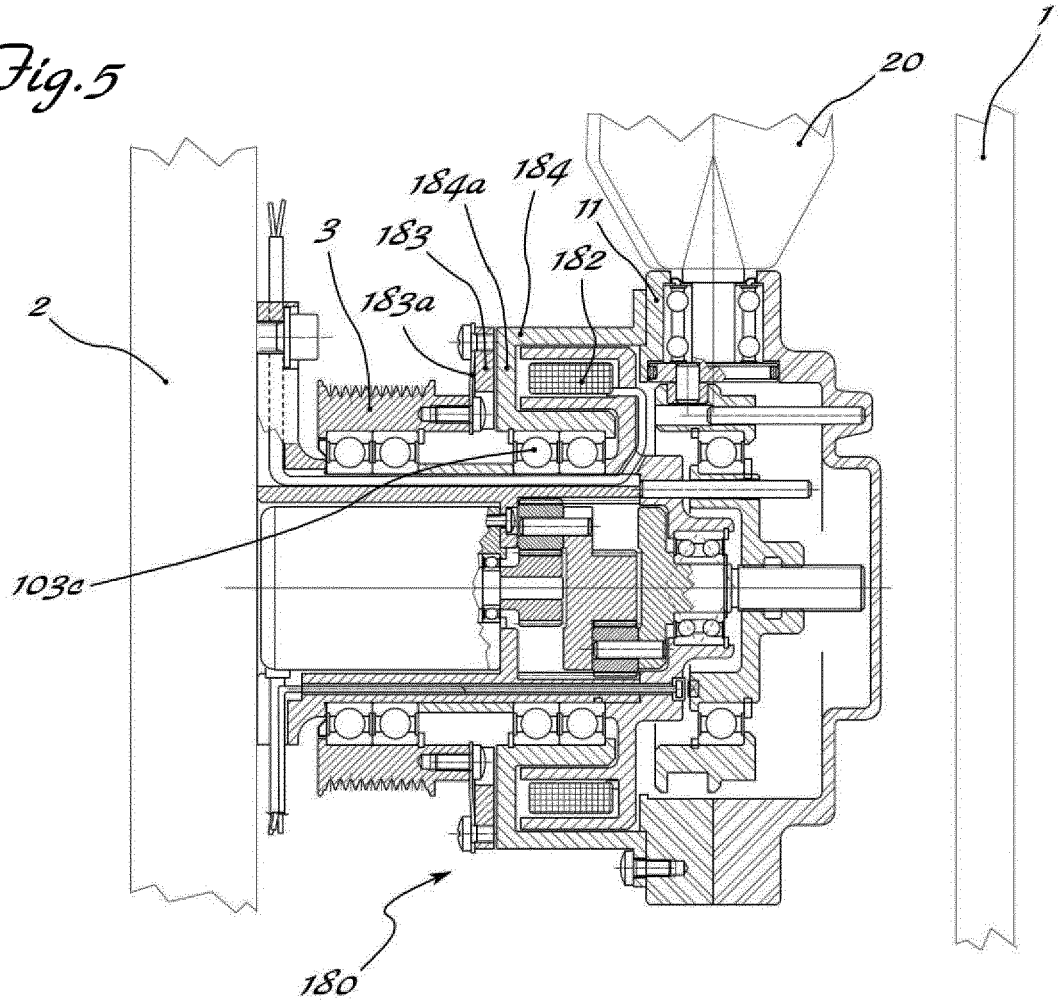
FIG. 5 shows a cross-section, similar to that of FIG. 1, of a further variation of embodiment of the apparatus shown in FIG. 3 for the fully stopped operating mode.
Figure 6:
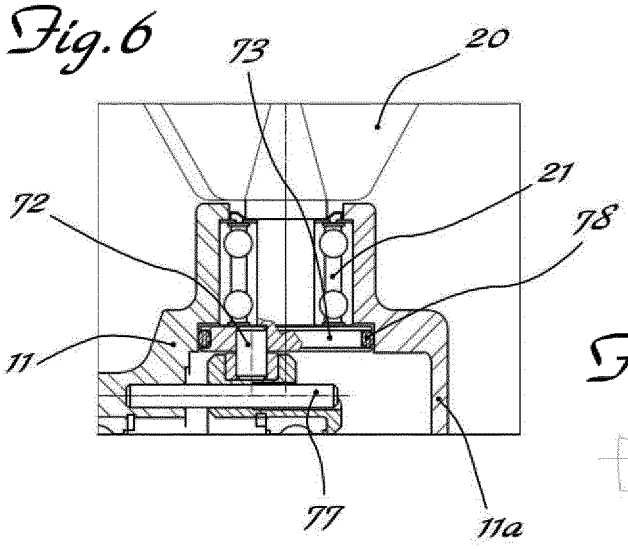
FIG. 6 shows a partially sectioned view of the detail of the anti-vibration connection between blade and means for rotation thereof.
Figure 7:
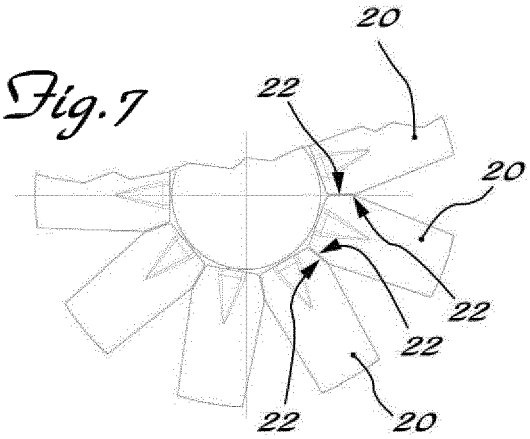
FIG. 7 shows a view of the fan according to the invention with blades provided with a suitable profile for rotation about their longitudinal axis.

FIG. 5 illustrates a further embodiment of the apparatus according to the invention; in this case it is envisaged that the pulley 3 is connected to the armature 183 of the clutch 180 (which therefore has a driving function), the relative connection being obtained by means of a resilient element 183*a* designed to allow axial movements of the armature 183, but prevent relative rotation of armature and hub; in this case the electromagnet 182 is mounted fixed on the sleeve 5, arranged concentrically with a flange 184 mounted on the second bearing 103*c* keyed onto the fixed support 5 and integral with the hub 11 of the fan and the flange 184 has a front surface 184*a* opposite the armature 183 with which it is coupled upon excitation of the electromagnet.

In this case the clutch is coaxial, axially on the outside of the pulley, allowing the radial dimensions of the pulley 3 to be kept small.

In the case of all the configurations shown in FIGS. 3, 4 and 5, when the clutch 80, 180, 280 is engaged following excitation of the electromagnet, the fan rotates at the speed of the pulley, but when instead the clutch is disengaged, the hub 11 of the fan is disconnected from rotating parts, stoppage thereof and hence the fully stopped operating mode being ensured.

Although not shown it is also envisaged that the clutch may be realized with spring means and/or permanent magnets which keep the clutch engaged and which produce deactivation following excitation of the electromagnet, thus ensuring fail-safe operation namely cooling also in the case of an electric fault. According to the preferred embodiments of the invention it is also envisaged that:

- a friction element 78 such as an O-ring is arranged between the annular edge of the base 73 and the surfaces of the hub 11 situated opposite it so as to totally eliminate residual vibrations of the blades 20 about their axis;
- the blades 20 of the fan have a radially inner part with chamfered edges 22—which are preferably symmetrical—designed to allow the rotation about the respective axis without relative interference between the adjacent blades; said blades may thus rotate through angles ≥180°;
- engagement of the clutch in order to start rotation of the fan is performed with blades rotated in the position of minimum interference with the air so that the torque supplied by the motor must overcome only the inertia of said blades, but not additional forces due to the resistance of the air to the rotation of the blades; in this way it is possible to limit the dimensions of the clutch for the same fan dimensions, or increase the dimensions of the fan for the same torque of the clutch.

As shown, owing to the arrangement of the apparatus and in particular the electric motor situated concentrically both with the bearing which supports the pulley connected to the heat engine and with the pulley itself, the radial dimensions of the pulley may be kept small such that the same thus results suitable for the high revolutions provided by the heat engine.

It can therefore be seen how, with the apparatus for actuating and controlling the rotation of blades 20 of cooling fans 10 about their longitudinal axis Y-Y, it is possible to obtain variable angular positioning and the position reached may be kept stable over a range of 360 degrees, with adjustment, therefore, of the entry angle during both suction and forced blowing.

In addition the static bell member of the multi-stage reduction gear also acts as a support for the apparatus and houses the bearings on which the pulley for receiving the rotational movement rotates, ensuring small dimensions and robustness.

Figure 8:
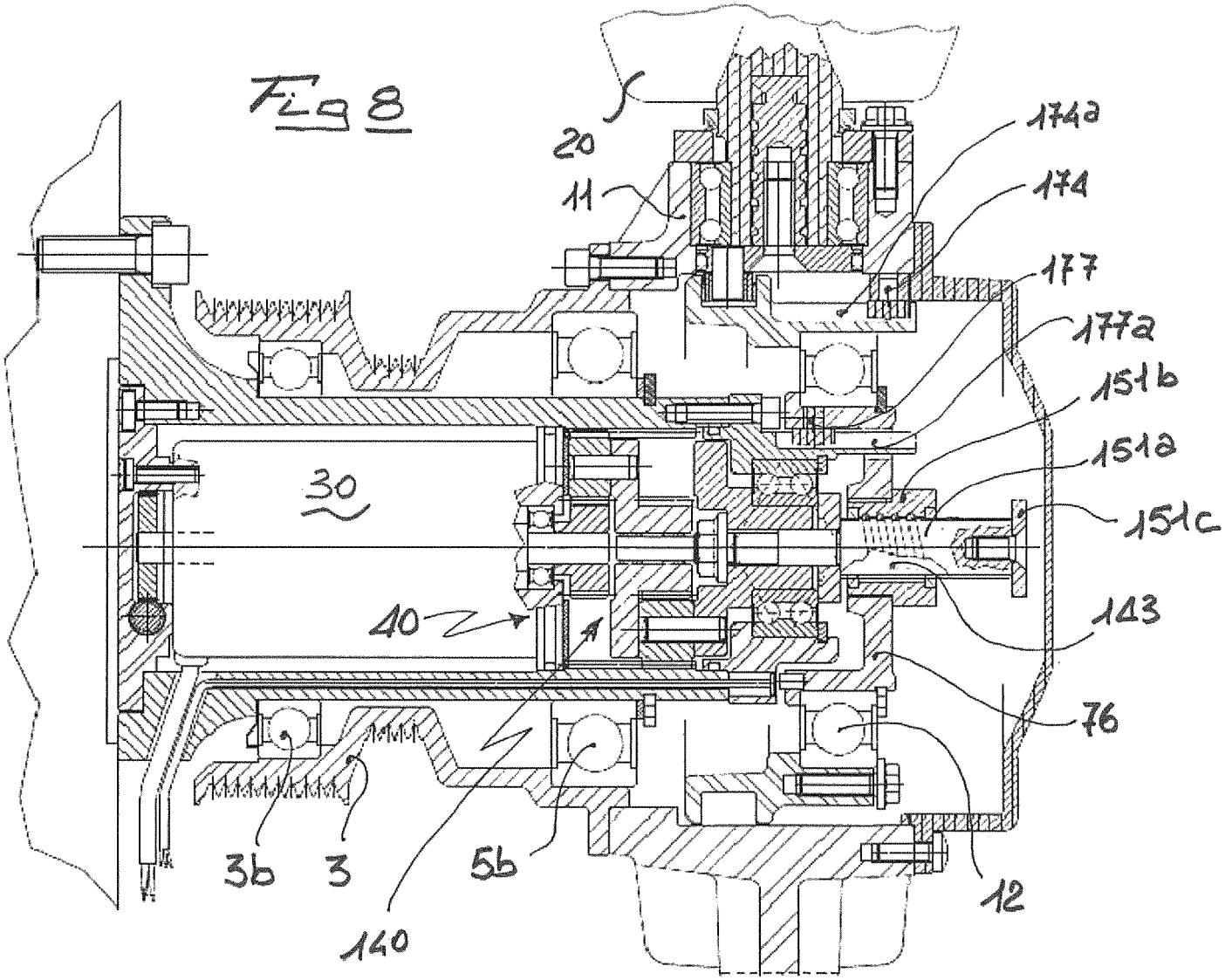
FIG. 8 shows an axial vertical section, similar to that of FIG. 1, incorporating variations of embodiment of the apparatus according to the present invention.

As shown in FIG. 8, further variations of embodiment of the apparatus according to the invention are envisaged; in detail:

- the first rod 77 extending parallel to the axis X-X and locked on the hub 11 and the second rod 74 passing axially through the slider 76 are respectively replaced by a radial dog 174,177, the head of which is axially slidable inside an associated groove 174*a*,176*a* which is radially open towards the outside of the ring 71 and the slider 76;
- the kinematic output element 143 is formed by a screw 151*a* coupled with a recirculating ball worm integral with the slider 76; the screw 151*a* has at its free axial end a mechanical stop 151*c* adapted to prevent the worm coming out in the axial direction in the event of malfunctioning of the rotation control system.

Although described in connection with a number of embodiments and a number of preferred examples of embodiment of the invention, it is understood that the scope of protection of the present patent is determined solely by the claims below.

The invention claimed is:

1. A cooling fan (10) assembly for operating machines and/or vehicles, in particular agricultural tractors and off-road vehicles, comprising a fan (10) with at least one blade (20) mounted on a hub (11) which can be rotationally driven about its axis (X-X) by associated driving means (3,3*a*) suitable for connection to a heat engine (1) of the vehicle and mounted on a fixed support (5) by means of a bearing (3*b*), and

- an apparatus for actuating and controlling the rotation about its longitudinal axis (Y-Y) of the at least one blade (20), the apparatus comprising:
  - a ring (71) provided with a radial seat (71*a*) inside which a radial pin (72), eccentrically engaged in a base (71) integral with the shank (20*a*) of the blade (20), is inserted;
  - an electric motor (30) which is coaxial with the axis (X-X) of the hub (11) and the shaft (31) of which is coaxially connected to a reduction gear (40), the kinematic output element (143) of which is coaxially connected by means of a screw (51*a*)/a female thread (76*a*) coupling to a slider (76) displaceable in both directions along the hub axis (X-X) and kinematically connected to the ring (71) with eccentric pin (72) for driving the base (73) integral with the shank of the blade;

wherein the reduction gear (40, 140) is a multi-stage epicyclic reduction gear coaxially arranged inside the fixed support (5), and the electric motor is coaxially inserted inside the fixed support (5) and fixed thereto.

2. The fan assembly of claim 1 wherein the driving means (3,3*a*) comprises a pulley (3) for connection to the heat engine (2), and the electric motor (30) and the reduction gear (40) are concentric with the pulley (3).

3. The fan assembly of claim 1 wherein said fixed support (5) is a hollow sleeve fixed to the base of the heat engine (1).

4. The fan assembly of claim 1 wherein the multi-stage epicyclic reduction gear (40) is of a two-stage type (40, 140).

5. The fan assembly of claim 1 wherein the output (143) of the kinematic chain connected to the screw (50) is coaxial and consists of the planet carrier (43; 143) of the last stage of the epicyclic reduction gear (40; 140).

6. The fan assembly of claim 1 wherein the screw (51*a*)/ and female thread (76*b*) coupling of the slider (76) is irreversible.

7. The fan assembly of claim 2 wherein the electric motor is of a brushless type and is used both as a drive and as a brake.

8. The fan assembly of claim 7 wherein, for operation as a brake, the windings of the motor are short-circuited.

9. The fan assembly of claim 7 wherein, for operation as a brake, a single phase of the motor is supplied with a lower voltage in order to oppose the action of the magnetic field of the permanent magnets of the motor.

10. The fan assembly of claim 1 wherein the apparatus for actuating and controlling the rotation about its longitudinal axis (Y-Y) of the at least one blade (20) comprises an electromagnetic clutch (80; 180; 280) arranged between a pulley (3) of the driving means (3, 3*a*) and the hub (11) of the fan.

11. The fan assembly of claim 10 wherein the clutch (80; 280) is arranged in an axial position concentric with the pulley (3), with a bearing (103*b*) supporting it and with the electric motor (30).

12. The fan assembly of claim 11 wherein an armature (83; 283) of the clutch is driven and is connected to an axial extension (11*a*; 111*a*) of the hub (11) of the fan.

13. The fan assembly of claim 12 wherein said axial extension (111*a*) of the hub (11) of the fan is prolonged towards the heat engine 92) so that the clutch (280, 282, 283) is located in a position axially on the outside of the electric motor (30).

14. The fan assembly of claim 10 wherein the electromagnetic clutch (180) is coaxial with and axially on the outside of the pulley (3) of the driving means.

15. The fan assembly of claim 14 wherein an armature (183) has a driving function.

16. The fan assembly of claim 15 wherein it comprises a flange (184) mounted on a second bearing (103*c*) keyed onto the fixed support (5), said flange (184) having a front surface (184*a*) situation opposite the armature (183) for relative engagement thereto upon excitation of the electromagnet.

17. The fan assembly of claim 1 further comprising a friction element (78) arranged between the annular edge of the base (73) and the surfaces of the hub (11) facing it.

18. The fan assembly of claim 1 further comprising a first radial dog (174) which is fixed on the hub (11) and the head of which is axially slidable inside an associated groove (174*a*) of the ring (71) and a second radial dog (176), the head (176*a*) of which is axially slidable inside a groove radially open towards the outside of the slider (76).

19. The fan assembly of claim 1 wherein the kinematic output element (143) of the reduction gear (140) is formed by a screw (151*a*) coupled with a recirculating ball worm (151*b*) integral with the slider (76).

20. The fan assembly of claim 19 wherein the screw (151*a*) has at its free axial end a mechanical stop (151*c*).

21. The fan assembly of claim 1 wherein the blades (20) of the fan have a radially inner part with chamfered edges (22).

22. The fan assembly of claim 1 wherein the blades (20) are rotated in a position where there is minimum interference with the air at the moment when the clutch is engaged in order to start rotation of the fan.

* * * * *